United States Patent [19]

Godkin et al.

[11] Patent Number: 4,808,955

[45] Date of Patent: Feb. 28, 1989

[54] MOVING COIL LINEAR ACTUATOR WITH INTERLEAVED MAGNETIC CIRCUITS

[75] Inventors: Mikhail Godkin, San Diego; Jack Kimble, Rancho Santa Fe, both of Calif.

[73] Assignee: BEI Electronics, Inc., San Francisco, Calif.

[21] Appl. No.: 105,400

[22] Filed: Oct. 5, 1987

[51] Int. Cl.[4] ..... H01F 7/08

[52] U.S. Cl. ..... 335/222; 310/13

[58] Field of Search ..... 335/222, 223, 224, 225, 335/226, 229, 230, 231; 310/13

[56] References Cited

U.S. PATENT DOCUMENTS

| | | | |
|---|---|---|---|
| 4,318,038 | 3/1982 | Munehiro | 310/13 |
| 4,669,013 | 5/1987 | Scranton | 310/13 |
| 4,692,999 | 9/1987 | Frandsen | 310/13 |
| 4,758,750 | 7/1988 | Itagaki | 310/13 |

*Primary Examiner*—H. Broome

*Attorney, Agent, or Firm*—Limbach, Limbach & Sutton

[57] ABSTRACT

According to a preferred embodiment of the present invention, a double-ended moving coil linear actuator is provided comprising a cylindrical core and a hollow shell disposed around the core to define an annular space between the inner wall of the shell and the outer wall of the core. A non-magnetic spacer is mounted in the annular space to divide the annular space into first and second annular cavities, each of the cavities having a closed end adjacent the spacer and an open end. A first set of magnets is mounted within the first annular cavity to define a first magnetic circuit. A second set of magnets is mounted within the second annular cavity to define a second magnetic circuit. The magnets of these two magnetic circuits are sized and arranged to define a third "interleaved" magnetic circuit which is created by the interaction of the first two circuits. Each of the first two magnetic circuits has a dual-winding coil assembly associated with it. The windings of the assembly are arranged to correspond to the arrangement of the magnets within the associated magnetic circuit.

14 Claims, 3 Drawing Sheets

MOVING COIL LINEAR ACTUATOR WITH INTERLEAVED MAGNETIC CIRCUITS

BACKGROUND OF THE INVENTION

1. Field of the Invention

The present invention relates to linear actuators and, in particular, to a moving coil linear actuator which utilizes the interaction of magnetic circuits to provide a desired air gap flux density in an actuator of minimal diameter or, alternatively, maximum force within a specified device envelope.

2. Discussion of the Prior Art

Linear actuators are electromagnetic devices that provide linear mechanical motion in response to the interaction of magnetic and electrical circuits.

As shown in FIG. 1, a typical "single-ended" moving coil linear actuator consists of a cylindrical inner core and an outer shell which surrounds the inner core to define an annular space between the two. An annular magnet of a certain polarity is mounted on the inner wall of the shell. A second corresponding annular magnet of opposite polarity is mounted on the outer wall of the core. These two magnets combine to form a magnetic circuit which generates a magnetic flux within the air gap between the two magnets. The air gap receives a moving coil assembly, or armature, which includes a cylindrical coil winding which is connected to an appropriate current source. In accordance with basic electrical principles, when current is supplied to the coil, a magnetic field is generated which opposes the magnetic field generated by the magnetic circuit. The opposing magnetic fields impart a force to the coil assembly which is proportional to the magnetic flux density in the air gap and current in the coil. This force is utilized to cause linear reciprocating movement of the coil assembly.

Linear actuators are utilized in many high precision applications since they suffer less wear and produce less contaminating particles than do conventional crankshaft piston assemblies. For example, in the simplest case, the linear movement of the armature may be used as a direct substitute for the linear motion provided by a rotary actuator of the type that requires a linkage assembly between a rotary motor and an actuator arm. By modifying the basic linear actuator device to incorporate a hollow core which receives longitudinally mounted sensors, the device may be used as an extremely sensitive position sensor, i.e. a "smart" actuator. By incorporating a piston structure and a fluid port that extends from the piston chamber through the outer wall of the shell, the device may be utilized as a compressor.

However, single-ended linear actuators of the type described above are inherently unbalanced and require the incorporation of additional mass strictly for the purpose of balancing the device. In some applications, this additional balancing mass is incorporated only with a corresponding decrease in generated activator force in order to meet specified device envelope requirements.

To compensate for the unbalanced characteristics of single-ended actuators, "back-to-back", double-ended actuator designs of the type illustrated in FIG. 2 are utilized in some applications. This double-ended design comprises, essentially, two independent single-ended devices of the type described above placed end-to-end. Each of the two independent magnetic circuits activates its respective coil assembly armature to produce self-cancelling strokes and, hence, a balanced device.

SUMMARY OF THE INVENTION

As mentioned above, in many applications requiring the use of a moving coil linear actuator, the device "envelope" is specified. That is, the inside diameter of the core is fixed, as is the outside diameter of the shell. The objective in these applications is to provide a linear actuator which generates maximum force within these fixed dimensional constraints. The present invention provides a magnetic circuit arrangement directed to this objective.

The concepts of the present invention are applicable to a variety of linear actuators of differing design. A number of these embodiments of the invention are described below.

In accordance with a preferred embodiment of the present invention, a double-ended moving coil linear actuator is provided which includes a cylindrical inner core and a hollow outer shell which is mounted around the core to define an annular air gap between the shell and the core. A non-magnetic spacer is mounted in the annulus between the shell and the core to define "back-to-back" linear actuators. According to a primary feature of the present invention, each of the back-to-back actuators includes a set of magnets that are arranged in a unique way to define "interleaved" magnetic circuits.

More specifically, the magnetic circuit of each actuator includes a first pair of magnets mounted at the outer end of the actuator's air gap. A second pair of magnets, spaced apart from the first pair, is mounted at the inner end of the air gap. The length of the second pair of magnets is twice that of the first pair. This configuration results in a third, "interleaved" magnetic circuit which is defined by the two inner pairs of magnets.

Each of the back-to-back actuators also includes a coil assembly having two spaced-apart coil windings connected to a current source. The two coil windings of each assembly correspond in length and spacing to the length and spacing of the corresponding magnetic elements. The two coils are wound so that current flow in the two coils is in opposite directions, thus matching the current flow to the polarities of the corresponding magnetic elements.

As stated above, dividing the flux paths of the two magnetic circuits to define the third "interleaved" magnetic circuit eliminates the need for a shell cross-sectional area capable of carrying the full magnetic flux. Therefore, more force may be generated within a specified device envelope, as compared to the conventional "back-to-back" design, by increasing the inside diameter of the shell and increasing the radial size of the magnets.

Alternatively, if the force required to be generated is fixed, then since the outer shell and the inside core carry only one-third of the total flux, the thickness of these two elements can be reduced compared to the convention "back-to-back" design, resulting in a smaller, lighter device that generates the required force.

Accordingly, it is an object of the present invention to provide a moving coil linear actuator which utilizes the interaction of interleaved magnetic circuits to provide flux for the actuator's moving coil assemblies.

It is also an object of the present invention to provide a moving coil linear actuator which requires less soft magnetic material and, thus, increases the actuator constant by making more room available for the magnets and the coil windings.

It is also an object of the present invention to provide a double-ended moving coil linear actuator wherein, since there is no magnetic member connecting the shell and the core, reluctance to the magnetic flux created by the moving coils is increased and armature reaction is decreased, resulting in a more constant force versus stroke characteristic.

These and other objects, features and advantages of the present invention will be better understood and appreciated by reference to the detailed description of the invention provided below which should be considered in conjunction with the accompanying drawings.

DETAILED DESCRIPTION OF THE INVENTION

Figure 1:
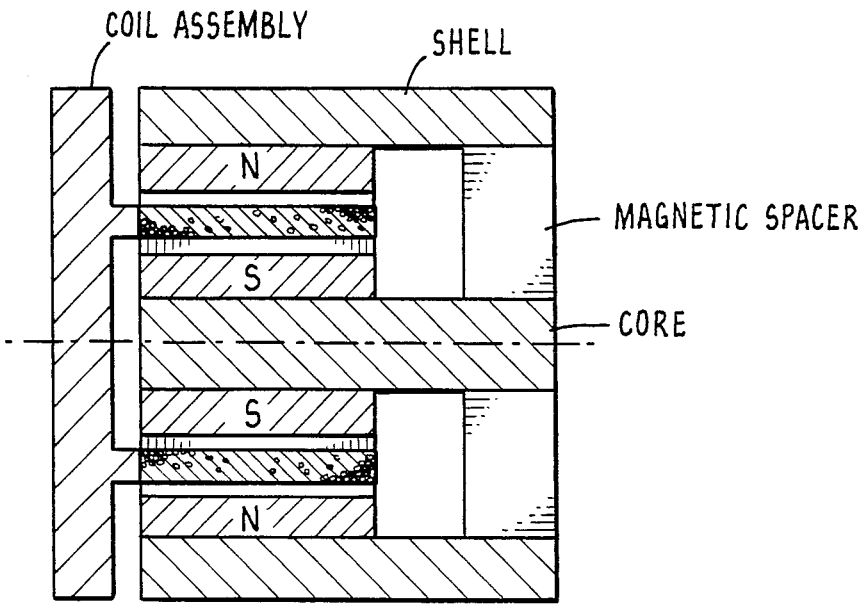
(PRIOR ART) FIG. 1.
FIG. 1 is a schematic diagram illustrating a conventional single-ended moving coil linear actuator.
Figure 2:
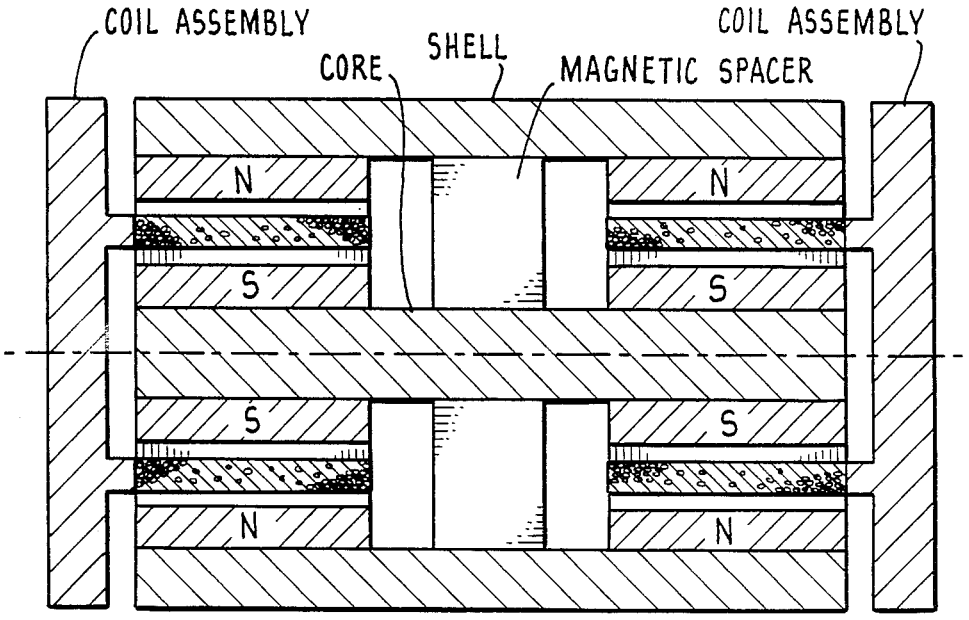
(PRIOR ART) FIG. 2.
FIG. 2 is a schematic diagram illustrating a conventional double-ended moving coil linear actuator.
Figure 3:
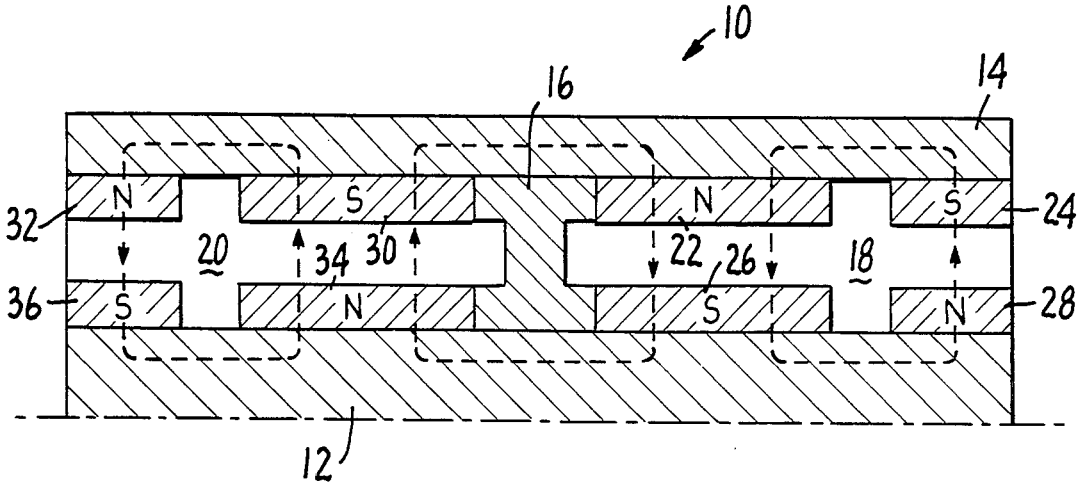
FIG. 3 is a half cross-sectional schematic diagram illustrating the magnetic circuit arrangement of an embodiment of a double-ended moving coil linear actuator in accordance with the present invention.

FIG. 3 provides an illustration of the magnetic circuits of a double-ended moving coiled linear actuator 10 arranged in accordance with the present invention.

The linear actuator 10 includes a cylindrical core 12 and a shell 14 which is disposed around the core 12 to define an annular space between the inner wall of the shell 14 and the outer wall of the core 12. A nonmagnetic spacer 16 is mounted in the annular space, at the actuator's longitudinal midpoint, to define a shell and core arrangement for back-to-back linear actuators.

A first set of magnets 22, 24, 26, 28 is mounted within an annular cavity 18 of what is illustrated in FIG. 3 as the "right-hand" actuator. An annular magnet 22 of a certain polarity, shown as North (N) in FIG. 3, is mounted on the inner wall of the shell 14 in proximity to the spacer 16. In the illustrated embodiment, magnet 22 is directly adjacent to spacer 16. An annular magnet 24 of a polarity opposite to that of magnet 22, i.e. South (S) in the FIG. 3 embodiment, is mounted on the inner wall of the shell 14 in proximity to the open end of the cavity 18. Magnet 24 is spaced apart from and is one-half the length of magnet 22. A third annular magnet 26 of a polarity opposite to that of magnet 22 is mounted on the outer wall of the core 12 in proximity to the spacer 16. Magnet 26 is the same length as and is mounted in longitudinal correspondence with magnet 22. A fourth annular magnet 28 of a polarity opposite that of magnet 24 is mounted in spaced apart relation from magnet 26 on the outer wall of the core 12 in proximity to the open end of the cavity 18. Magnet 28 is the same length as and is mounted in longitudinal correspondence with magnet 24.

Thus, magnets 22 and 26 define an "inner" pair of magnets for the first actuator, while magnets 24 and 28 define an "outer" pair of magnets for the first actuator.

As further shown in FIG. 3, a second set of magnets, similar to the first set, is mounted within an annular cavity 20 of what is illustrated in FIG. 3 as a second "left-hand" actuator. The second set of magnets includes an annular magnet 30, of opposite polarity to that of magnet 22, which is mounted on the inner wall of the shell 12 in proximity to the spacer 16. In the illustrated embodiment, magnet 30 is directly adjacent to spacer 16. An annular magnet 32 of a polarity opposite to that of magnet 30 is mounted on the inner wall of the shell 12 in proximity to the open end of the cavity 20. Magnet 32 is spaced apart from and is one-half the length of magnet 30. An annular magnet 34 of a polarity opposite to that of magnet 30 is mounted on the outer wall of the core 12 in proximity to the spacer 16. Magnet 34 is the same length as and is mounted in longitudinal correspondence with magnet 30. An annular magnet 36 of opposite polarity to that of magnet 32 is mounted in spaced apart relation from magnet 34 on the outer wall of the core 12 in proximity to the open end of the cavity 20. Magnet 36 is the same length as and is mounted in longitudinal correspondence with magnet 32.

Thus, magnets 30 and 34 define an "inner" pair of magnets for the second actuator, while magnets 32 and 36 define an "outer" pair of magnets for the second actuator.

As shown in FIG. 3, the arrangement of magnets in the manner described above results in the definition of three magnetic circuits. A first magnetic circuit is defined by magnets 22, 24, 26 and 28. Similarly, a second magnetic circuit is defined by magnets 30, 32, 34 and 36. Additionally, and in accordance with the present invention, the "inner" magnets of the two above-defined sets of magnets interact to provide a third magnetic circuit. That is, a third "interleaved" magnetic circuit is defined by the interaction of magnets 22, 26, 34 and 30. The flux lines of the third, interleaved magnetic circuit also pass through the core element 12 and the shell 14 and the two air gaps such that the core 12 and the shell 14 carry only one-third of the total flux, thereby reducing the flux of the first two magnetic circuits.

Figure 4:
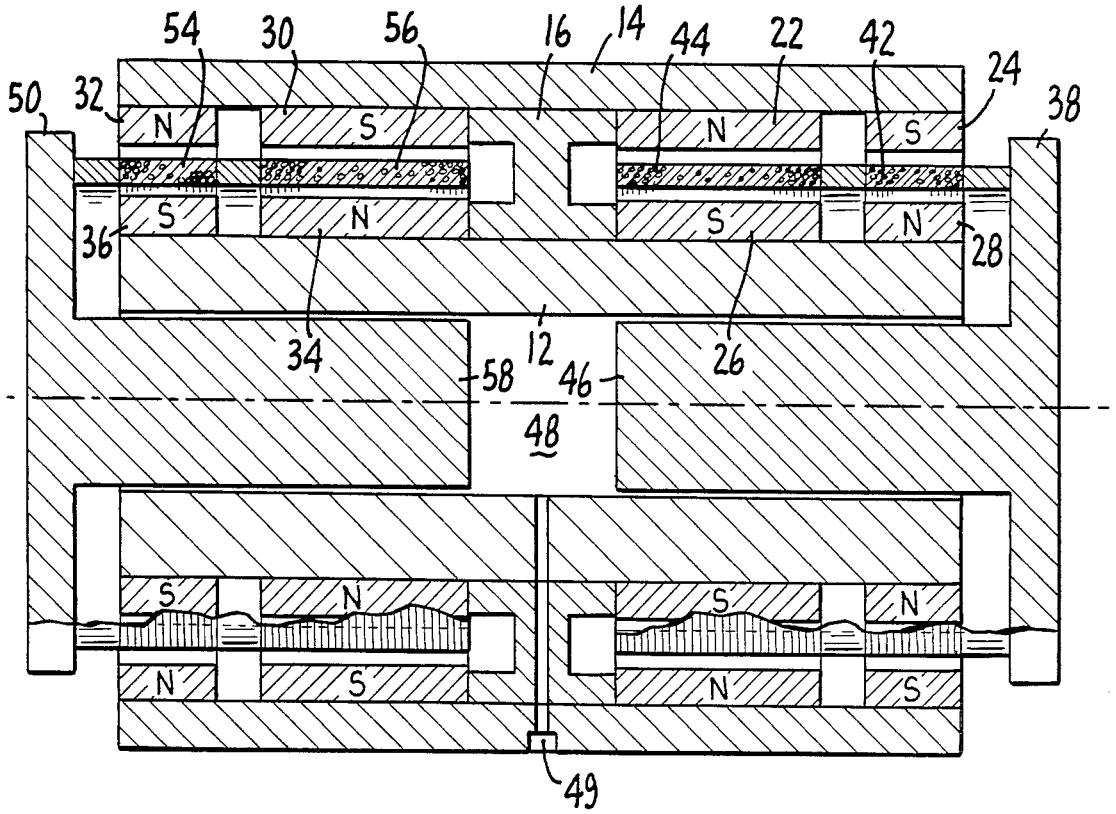
FIG. 4 is a partially cut-away schematic diagram illustrating a double-ended linear compressor that utilizes the magnetic circuit arrangement shown in FIG. 3.

FIG. 4 shows a detailed embodiment of a double-ended moving coil linear compressor which utilizes a magnetic circuit arrangement of the type described above with respect to FIG. 3. Like elements in FIGS. 3 and 4 are similarly identified.

In the FIG. 4 embodiment, the material used for each of the magnets is Neodymium-Iron-Boron. The core 12 and the shell 14 are formed from cold rolled steel. The non-ferromagnetic material conventionally utilized in this type of device, e.g., stainless steel or aluminum.

As shown in FIG. 4, in addition to the magnetic circuit arrangement shown in FIG. 3, the double-ended moving coil linear compressor further includes a coil assembly 38 which is movably disposed within the air gap of the first actuator. The coil assembly 38 includes a first coil winding 42 and a second coil winding 44 which is spaced apart from the first winding 42. Both windings 42 and 44 are connected to an appropriate dc power supply. Winding 44 is twice the length of winding 42, the lengths and spacing of windings 42 and 44 corresponding to the lengths and spacing of the corresponding inner and outer pairs of magnets 24, 28 and 22, 26, respectively. Windings 42 and 44 are wound on the assembly 38 so that current flow in the two windings is in opposite directions to correspond to the polarities of the associated magnets 24, 28 and 22, 26, respectively.

A first piston 46, which is attached to coil assembly 38, is slidably mounted within a piston chamber 48 formed in the core 12.

A discharge port 49 provides fluid communication between the piston chamber 48 and the external environment through the core wall, spacer 16 and shell 14.

As further shown in FIG. 4, a second coil assembly 50, which is identical to the coil assembly 38 described above, is movably disposed within the air gap of the second actuator. The coil assembly 50 includes a coil winding 54 and a coil winding 56 which is spaced apart from winding 54 and is twice its length, the length and spacing of windings 54 and 56 corresponding to the lengths and spacing of the inner and outer pairs of corresponding magnets 30, 34 and 32, 36, respectively. Both windings 54 and 56 are connected to an appropriate dc supply. Windings 54 and 56 are wound on the assembly 50 so that current flow in the two windings is in opposite directions to correspond to the polarities of the associated magnets 32, 36 and 30, 34, respectively.

A piston 58, which is attached to coil assembly 50, is slidably mounted within the piston chamber 48.

Thus, when current flow in the coil windings 42, 44 and 54, 56, magnetic fields are created to interact with the fields generated by the corresponding magnetic circuits, causing linear motion of the coil assemblies 38 and 50 with attendant reciprocating motion of pistons 46 and 48, respectively.

Figure 5:
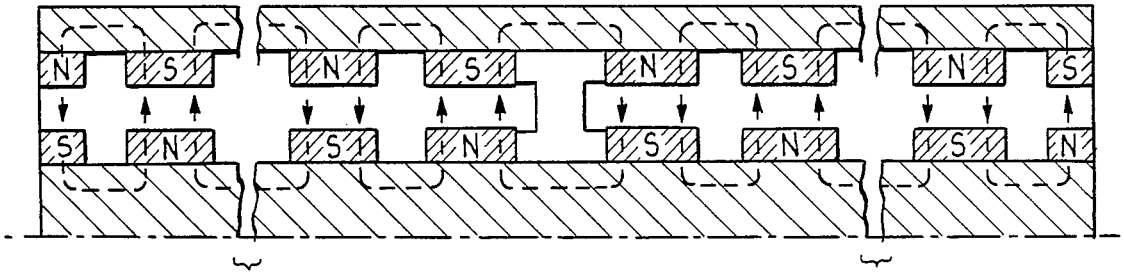
FIG. 5 is a schematic diagram illustrating a double-ended, moving coil linear actuator that incorporates multiple magnetic circuits in accordance with the general concept of the present invention.

The concept of the present invention illustrated in FIG. 4 may be expanded to encompass a double-ended moving coil linear actuator with any number of magnetic circuits. For example, FIG. 5 shows a magnetic circuit arrangement for a double-ended, moving coil linear actuator which utilizes multiple magnetic circuits in accordance with the present invention. Each of the magnetic elements in the device shown in FIG. 5 is of the same length except those closest to the open end of the actuator, which are one-half the length of the other elements.

Figure 6:
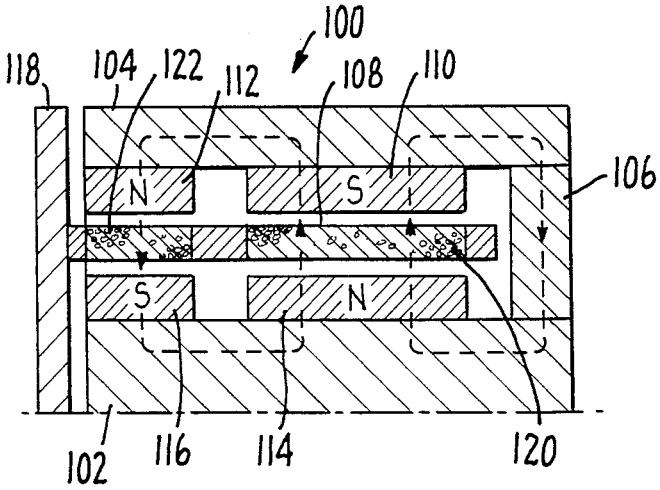
FIG. 6 is a schematic diagram illustrating an embodiment of a magnetic circuit arrangement for a single-ended moving coil linear actuator in accordance with the present invention.

An alternative "single-ended" embodiment of a linear actuator which utilizes the concepts of the present invention is shown in FIG. 6.

The single-ended moving coil linear actuator 100 shown in FIG. 6 comprises a core 102 and a shell 104 which is disposed around the core 102 to define an annular space between the inner wall of the shell 104 and the outer wall of the core 102. A wall 106 of magnetic material is formed between the inner wall of the shell 104 and the outer wall of the core 102 to define an annular cavity 108 having a closed end adjacent the magnetic wall 106 and an open end. A set of magnets is mounted within the annular cavity 108 to define an air gap. A first annular magnet 110 of a certain polarity is mounted on the inner wall of the shell 104 in proximity to, but spaced apart from the magnetic wall 106. A second annular magnet 112 of opposite polarity to that of the first magnet 110 is mounted on the inner wall of the shell 104 in proximity to the open end of the cavity 108. The second magnet 112 is spaced apart from the first magnet 110. The length of the first magnet 110 is twice that of the second magnet 112; that is, magnet 110 comprises two-thirds of the total length of the two magnets 110, 112 while magnet 112 comprises one-third of the total length. A third annular magnet 114 of the same polarity as magnet 112 is mounted on the outer wall of the core 102 in proximity to, but spaced apart from the magnetic wall 106. Magnet 114 is the same length as and is mounted in longitudinal correspondence with magnet 110. A fourth annular magnet 116 of the same polarity as magnet 110 is mounted on the outer wall of the core 102 in proximity to the open end of the cavity 108. Magnet 116 is spaced apart from magnet 114; it is the same length as and is mounted in longitudinal correspondence with magnet 112.

As further shown in FIG. 6, the single-ended moving coil linear actuator of the present invention further includes a coil assembly 118 which is movably disposed within the air gap 108. The coil assembly 118 includes a first coil winding 120 which is longitudinally disposed in the air gap between the first magnet 110 and the third magnet 114. A second coil winding 122, which is spaced apart from the first coil 120, is longitudinally disposed in the air gap between the second magnet 112 and the fourth magnet 116. Winding 120 is twice the length of winding 122, the lengths and spacing of the windings 120 and 122 corresponding to the lengths and spacing of the corresponding inner and outer pairs of magnets 110, 114 and 112, 116, respectively. Windings 120 and 122 are wound on the assembly 118 so that current flow in two windings is in opposite directions.

Figure 7:
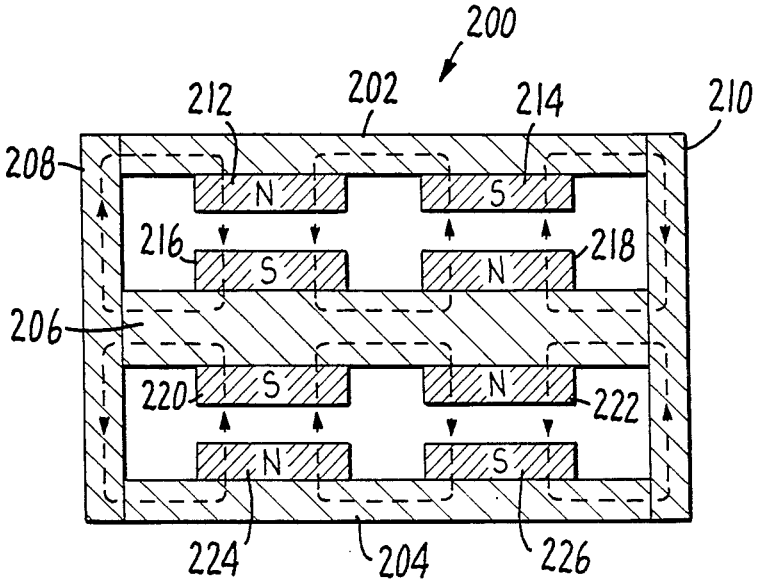
FIG. 7 is a schematic diagram illustrating a rectangular moving coil linear actuator which utilizes an interleaved magnetic circuit arrangement in accordance with the present invention.

FIG. 7 illustrates an application of the "interleaved" magnetic circuit concepts of the present invention to a linear actuator of rectangular configuration.

The rectangular actuator magnetic circuit arrangement 200 illustrated in FIG. 7 includes upper and lower plates 202 and 204 with an intermediate core plate 206 disposed between them; two end plates 208 and 210 complete the actuator housing in the conventional manner. Each of the plates is formed from a magnetic material such as cold rolled steel. The difference between the magnetic circuits of a conventional rectangular actuator and the design shown in FIG. 7, is that the illustrated design utilizes an arrangement of magnets which results in the definition of shared magnetic circuits and, thus, a redistribution of the flux to allow less material to be used in the actuator housing, as described above in conjunction with the FIGS. 1–6 embodiments of the invention.

FIG. 7 shows a rectangular magnet 212 of a certain polarity, shown as North (N) in the illustrated embodiment, mounted on the inner wall of the upper plate 202 and spaced-apart from the end plate 208. A magnet 214 of polarity opposite to that of magnet 212, i.e. South (S) in the FIG. 7 embodiment, is mounted on the inner wall of upper plate 202 and is spaced-apart from both magnet 212 and end plate 210. A third magnet 216 of opposite polarity to that of magnet 212 is mounted on the upper wall of the intermediate plate 206 in longitudinal correspondence with magnet 212. A fourth magnet of polarity opposite to that of magnet 214 is mounted on the upper wall of intermediate plate 206 in longitudinal correspondence with magnet 214.

Similarly, a second set of four magnets 220, 222, 224 and 226 is mounted in the lower cavity between the intermediate plate 206 and the lower plate 204 as a mirror image of the first set of four magnets 212, 214, 216 and 218.

As shown in FIG. 7, the two sets of magnets described above define shared magnetic circuits in accordance with the concepts of the present invention.

Similar to the embodiments of the invention described above, rather than utilizing a single coil as in the conventional rectangular design, two coils are utilized with the FIG. 7 design, the two coils being wound on the same coil base in spaced-apart relationship to correspond to the spacing of the associated magnets. The two coils are wired to provide current in opposite directions, consistent with the concepts of the invention described above.

Brackets are mounted at both sides of the substantially rectangular coil combination in the conventional manner. Thus, an armature can be attached to the brackets to provide for linear movement of the armature as the coil assembly moves longitudinally within the actuator housing when current flows in the two coils.

Those skilled in the art will easily appreciate that the design shown in FIG. 7 may be modified by eliminating the two pairs of magnets which are mounted on the upper and lower surfaces of the intermediate plate 206, resulting in rectangular actuator which is less efficient than the embodiment shown in FIG. 7, but which retains the benefits resulting from the use of interleaved magnetic circuits in accordance with the present invention.

It should be understood that various alternatives to the embodiments of the invention described herein may be employed in practicing the invention. It is intended that the following claims define the scope of the invention and that the structured within the scope of these claims and their equivalents be covered thereby.

What is claimed is:

1. In a moving coil linear actuator of the type that includes a core and a cylindrical shell disposed around the core to define an annular space therebetween and a spacer mounted between the core and the shell to close the actuator at one of its ends and wherein a coil assembly is disposed for linear movement within the annular space, the improvement comprising a magnetic circuit arrangement that includes a first pair of annular magnets of opposite polarity mounted in proximity to the closed end of the actuator, one magnet of the first pair being mounted on the outer wall of the core and the other magnet of the first pair being mounted on the inner wall of the shell, and a second pair of annular magnets of opposite polarity mounted in spaced apart relation to the first pair and in proximity to the open end of the actuator, one magnet of the second pair being mounted on the outer wall of the core and the other magnet of the second pair being mounted on the inner wall of the shell, the magnets of the first pair being twice the length of the second pair such that multiple interleaved magnetic circuits are defined by the first pair and the second pair; and a pair of spaced apart coil windings formed on the coil assembly and connected to a current source, the lengths and spacing of the first and second windings corresponding to the lengths and spacing of the first and second pairs of magnets, respectively, the first and second windings being wound on the coil assembly so that current flow in the two windings is in opposite directions to correspond to the polarities of the first and second pairs of magnets, respectively.

2. A moving coil linear actuator as in claim 1 and further including one or more additional pairs of spaced apart magnets disposed between the first pair and the second pair, each additional pair including one magnet mounted on the outer wall of the core and the other magnet mounted on the inner wall of the shell, the magnets of the additional pairs being of the same length as the magnets of the first pair, and wherein the coil assembly includes one or more additional coil windings corresponding to the number of additional pairs of magnets.

3. A moving coil single-ended linear actuator comprising:

a core;

a cylindrical shell mounted around the core to define an annular space therebetween;

a magnetic wall mounted between the core and the shell to close the annular space at one of its ends;

a first magnet of a certain polarity mounted in the annular space on the inner wall of the shell in proximity to the magnetic wall;

a second magnet of opposite polarity to that of the first magnet mounted in the annular space on the outer wall of the shell, the second magnet having the same length as and mounted in longitudinal correspondence with the first magnet;

a third magnet of opposite polarity to that of the first magnet mounted in the annular space on the inner wall of the shell in spaced apart relation to the first magnet and in proximity to the open end of the annular space;

a fourth magnet of the certain polarity mounted in the annular space on the outer wall of the core, the fourth magnet having the same length as and mounted in longitudinal correspondence with the third magnet;

a coil assembly movably disposed within the annular space, coil assembly including a first coil winding of the same length as the first and second magnets and a second coil winding spaced apart from the first winding and of the same length as the third and fourth magnets, the first and second coil windings being wound so that the current flow in the two windings is in opposite directions wherein the first and second magnets are twice as long as the third and fourth magnets.

4. A double-ended moving coil linear actuator comprising a cylindrical core;

a hollow shell disposed around the core in space apart relationship to define an annular space between the inner wall of the shell and the outer wall of the core;

a non-magnetic spacer mounted in the annular space to divide the annular space into first and second annular cavities, each of the cavities having a closed end adjacent the spacer and an open end;

each of the annular cavities having a magnetic circuit arrangement disposed therein that includes a first pair of annular magnets of opposite polarity mounted in proximity to the closed end of the cavity, one magnet of the first pair being mounted on the outer wall of the core and the other magnet of the first pair being mounted on the inner wall of the shell, and a second pair of annular magnets of opposite polarity mounted in spaced apart relation to the first pair and in proximity to the open end of the cavity, one magnet of the second pair being mounted on the outer wall of the core and the other magnet of the second pair being mounted on the inner wall of the shell, the magnets of the first pair being twice the length of the second pair such that multiple magnetic circuits are defined by the first pair and the second pair including an interleaved magnetic circuit; and each of the annular cavities having a moving coil assembly disposed therein, the moving coil assembly comprising a coil assembly movably disposed within the annular space, coil assembly including a first coil winding of the same length as the first and second magnets and a second coil winding spaced apart from the first winding and of the same length as the third and fourth magnets, the first and second coil windings being wound so that the current flow in the two windings is in opposite directions wherein the first and second magnets are twice as long as the third and fourth magnets.

5. A double-ended moving coil linear actuator as in claim 4 and wherein each of the annular cavities includes one or more additional pairs of spaced apart magnets, one element of each additional pair being mounted on the outer wall of the core and the other magnet being mounted on the inner wall of the shell, the magnets of the additional pairs being of the same length as the first pair of magnets.

6. A double-ended moving coil linear actuator as in claim 5 and wherein each of the coil assemblies includes one or more additional coil windings corresponding to the number of additional pairs of magnets.

7. A double-ended moving coil linear compressor comprising:

(a) a cylindrical core having a piston chamber formed therein along its longitudinal axis;

(b) a hollow shell disposed around the core in spaced apart relationship to define an annular space between the inner wall of the shell and the outer wall of the core;

(c) a non-magnetic spacer mounted in the annular space to divide the annular space into first and second annular cavities, each of the cavities having a closed end adjacent the spacer and an open end;

(d) a first set of magnets mounted within the first annular cavity to define a first annular air gap within the first cavity and comprising (i) a first annular magnet of a certain polarity mounted on the inner wall of the shell in proximity to the closed end of the first cavity;

(ii) a second annular magnet of a polarity opposite to that of the first magnet mounted on the inner wall of the shell in proximity to the open end of the first cavity, the second magnet being spaced apart from the first magnet;

(iii) a third annular magnetic magnet of the opposite polarity mounted on the outer wall of the core in proximity to the closed end of the first cavity and in longitudinal correspondence with the first magnet; and (iv) a fourth annular magnet of the certain polarity mounted on the outer wall of the core in proximity to the open end of the first cavity, the fourth magnet being spaced apart from the third magnet and mounted in longitudinal correspondence with the second magnet;

(e) a second set of magnets mounted within the second annular cavity to define a second annular air gap within the second cavity and comprising;

(i) a fifth annular magnet of the opposite polarity mounted on the inner wall of the shell in proximity to the closed end of the second cavity;

(ii) a sixth annular magnet of the certain polarity mounted on the inner wall of the shell in proximity to the open end of the second cavity, the sixth magnet being spaced apart from the fifth magnet;

(iii) a seventh annular magnet of the certain polarity mounted on the outer wall of the core in proximity to the closed end of the second cavity and in longitudinal correspondence with the fifth magnet; and (iv) an eighth annular magnet of the opposite polarity mounted on the outer wall of the core in proximity to the open end of the second cavity, the eighth magnet being spaced apart from the seventh magnet and mounted in longitudinal correspondence with the sixth magnet;

(f) a first coil assembly connected to a current source and moveably disposed within the first air gap and comprising (i) a first coil longitudinally disposed in the first air gap between the first magnet and the third magnet;

(ii) a second coil spaced apart from the first coil and longitudinally disposed in the first air gap between the second magnet and the fourth magnet; and (iii) a first piston slidably mounted within the piston chamber; and (g) a second coil assembly connected to a current source and moveably disposed within the second air gap and comprising (i) a third coil longitudinally disposed in the second air gap between the fifth magnet and the seventh magnet;

(ii) a fourth coil spaced apart from the third coil and longitudinally disposed in the second air gap between the sixth magnet and the eighth magnet; and (iii) a second piston slidably mounted within the piston chamber and wherein a first magnetic circuit is defined by the first, second, third and fourth magnets, a second magnetic circuit is defined by the fifth, sixth, seventh and eighth magnets, and a third magnetic circuit is defined by the interaction of the first, third, seventh and fifth magnets.

8. In a rectangular linear moving coil actuator of that type that includes an upper plate and a lower plate and an intermediate plate mounted between the upper and lower plates in spaced-apart relation thereto, each of the upper plate, the lower plate and the intermediate plate being engaged at opposing ends by a pair of end plates to define an upper cavity between the intermediate plate and the upper plate and a lower cavity between the intermediate plate and the lower plate, the improvement comprising a magnetic circuit arrangement that includes a first pair of magnets of opposite polarity mounted on the inner wall of the upper plate in spaced-apart relation to each other and to the end plates, a second pair of magnets of opposite polarity mounted on the upper wall of the intermediate plate in spaced-apart relation to each other and to the end plates, the first and second pairs being mounted in longitudinal correspondence to each other, a third pair of magnets of opposite polarity mounted on the inner wall of the lower plate in spaced apart relation to each other and to the end plates, and a fourth pair of magnets of opposite polarity mounted on the lower wall of the intermediate plate in spaced-apart relation to each other and to the end plates, the third and fourth pairs being mounted in longitudinal correspondence to each other.

9. In a moving coil linear actuator of the type that includes a first member, a second member disposed in spaced apart relationship to the first member to define a gap therebetween, a spacer member mounted between the first member and the second member to define an actuator cavity having a closed end and an open end, and a coil assembly disposed for linear movement within the gap, the improvement comprising a magnetic circuit arrangement that includes a first pair of magnets of opposite polarity mounted in proximity to the closed end of the actuator cavity, one magnet of the first pair being mounted on the first member in the gap and the other magnet of the first pair being mounted on the second member in the gap, and a second pair of magnets of opposite polarity mounted in spaced apart relation to the first pair and in proximity to the open end of the actuator cavity, one magnet of the second pair being mounted on the first member in the gap and the other magnet of the second pair being mounted on the second member in the gap, such that multiple magnetic circuits are defined by the magnetic circuit arrangement including a magnetic circuit the flux lines of which pass through the spacer member; and first and second spaced apart coil windings formed on the coil assembly in correspondence to the first and second pairs of magnets, respectively, the first and second coil windings being connectable to a current source and being wound on the coil assembly so that current flow in the two coil windings is in opposite directions to correspond to the polarities of the first and second pairs of magnets, respectively.

10. A moving coil linear actuator as in claim 9 and further including one or more additional pair of magnets disposed between and spaced apart from the first pair and the second pair, each additional pair including one magnet mounted on the first member in the gap and the other magnet mounted on the second member in the gap, and wherein the coil assembly includes one or more additional coil windings corresponding to the number of additional pairs of magnets.

11. In a moving coil linear actuator of the type that includes a core and a cylindrical shell disposed around the core to define an annular space therebetween, a spacer mounted between the core and the shell to define an actuator cavity having a closed end and an open end, and a coil assembly disposed for linear movement within the annular space, the improvement comprising a magnetic circuit arrangement that includes a first pair of annular magnets of opposite polarity mounted in proximity to the closed end of the actuator cavity, one magnet of the first pair being mounted on the outer wall of the core and the other magnet of the first pair being mounted on the inner wall of the shell, and a second pair of annular magnets of opposite polarity mounted in spaced apart relation to the first pair and in proximity to the open end of the actuator cavity, one magnet of the second pair being mounted on the outer wall of the core and the other magnet of the second pair being mounted on the inner wall of the shell, such that multiple magnetic circuits are defined by the magnetic circuit arrangement including a magnetic circuit the flux lines of which pass through the spacer; and first and second spaced apart coil windings formed on the coil assembly in correspondence to the first and second pairs of magnets, respectively, the first and second coil windings being connectable to a current source and being wound on the coil assembly so that current flow in the first and second coil windings is in opposite directions to correspond to the polarities of the first and second pairs of magnets, respectively.

12. A double-ended moving coil linear actuator comprising a first ferromagnetic member;

a second ferromagnetic member disposed in spaced apart relationship to the first member to define a gap between the first member and the second member;

a non-magnetic spacer mounted in the gap to divide the gap into first and second cavities, each of the cavities having a closed end adjacent the spacer and an open end;

each of the cavities having a magnetic circuit arrangement disposed therein that includes a first pair of magnets of opposite polarity mounted in proximity to the closed end of the cavity, one magnet of the first pair being mounted on the first member in the gap and the other magnet of the first pair being mounted on the second member in the gap, and a second pair of magnets of opposite polarity mounted in spaced apart relation to the first pair and in proximity to the open end of the cavity, one magnet of the second pair being mounted on the first member in the gap and the other magnet of the second pair being mounted on the second member in the gap such that multiple magnetic circuits are defined by the two magnetic circuit arrangements including an interleaved magnetic circuit; and each of the cavities having a moving coil assembly disposed therein, the moving coil assembly comprising first and second spaced apart coil windings formed on the coil assembly in correspondence to the first and second pairs of magnets, respectively, the first and second windings being connectable to a current source and being wound on the coil assembly so that current flow in the first and second windings is in opposite directions to correspond to the polarities of the first and second pairs of magnets, respectively.

13. A double-ended moving coil linear actuator as in claim 12 wherein each of the cavities includes one or more additional pair of magnets disposed between and spaced apart from the first pair and the second pair, each additional pair including one magnet mounted on the first member in the gap and the other magnet mounted on the second member in the gap, and wherein the coil assembly includes one or more additional coil windings corresponding to the number of additional pairs of magnets.

14. A double-ended moving coil linear actuator comprising a cylindrical ferromagnetic core;

a hollow ferromagnetic shell disposed around the core to define an annular space therebetween, a nonmagnetic spacer mounted in the annular space to divide the annular space into first and second annular cavities, each of the cavities having a closed end adjacent the spacer and an open end;

each of the annular cavities having a magnetic circuit arrangement disposed therein that includes a first pair of annular magnets of opposite polarity mounted in proximity to the closed end of the cavity, one magnet of the first pair being mounted on the outer wall of the core and the other magnet of the first pair being mounted on the inner wall of the shell, and a second pair of annular magnets of opposite polarity mounted in spaced apart relation to the first pair and in proximity to the open end of the cavity, one magnet of the second pair being mounted on the outer wall of the core and the other magnet of the second pair being mounted on the inner wall of the shell such that multiple magnetic circuits are defined by the two magnetic circuit arrangement including an interleaved magnetic circuit; and each of the annular cavities having a moving coil assembly disposed therein, the moving coil assembly comprising first and second spaced apart coil windings formed on the coil assembly in correspondence to the first and second pairs of magnets, respectively, the first and second windings being connectable to a current source and being wound on the coil assembly so that current flow in the first and second windings is in opposite directions to correspond to the polarities of the first and second pairs of magnets, respectively.

* * * * *